US011859331B2

(12) United States Patent
Chun et al.

(10) Patent No.: US 11,859,331 B2
(45) Date of Patent: Jan. 2, 2024

(54) TUB FIXING DEVICE AND WASHING MACHINE COMPRISING THE SAME

(71) Applicant: Samsung Electronics Co., Ltd., Suwon-si (KR)

(72) Inventors: Kwangmin Chun, Suwon-si (KR); Bokyun Kim, Suwon-si (KR); Kwonwoo Nam, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 130 days.

(21) Appl. No.: 17/136,477

(22) Filed: Dec. 29, 2020

(65) Prior Publication Data

US 2021/0198830 A1 Jul. 1, 2021

(30) Foreign Application Priority Data

Dec. 31, 2019 (KR) ..... 10-2019-0179637

(51) Int. Cl.
*D06F 37/22* (2006.01)
*D06F 37/04* (2006.01)

(52) U.S. Cl.
CPC ..... *D06F 37/22* (2013.01); *D06F 37/04* (2013.01)

(58) Field of Classification Search
CPC ..... D06F 37/22; D06F 37/04; D06F 37/26; D06F 39/001; D06F 39/125
USPC ..... 68/139
See application file for complete search history.

(56) References Cited

U.S. PATENT DOCUMENTS

2004/0118167 A1* 6/2004 Kim ..... D06F 39/001 68/3 R
2018/0105968 A1* 4/2018 Lee ..... D06F 37/06

FOREIGN PATENT DOCUMENTS

| | | | |
|---|---|---|---|
| KR | 20000013797 U | * | 12/1998 |
| KR | 10-2000-0013797 | | 3/2000 |
| KR | 10-2005-0113977 | | 12/2005 |
| KR | 10-2006-0085801 | | 7/2006 |
| KR | 10-0762319 | | 10/2007 |
| KR | 10-2007-0108735 | | 11/2007 |
| KR | 10-1100308 | | 12/2011 |

OTHER PUBLICATIONS

KR20000013797U—machine translation (Year: 2000).*

* cited by examiner

*Primary Examiner* — Tinsae B Ayalew
(74) *Attorney, Agent, or Firm* — STAAS & HALSEY LLP

(57) ABSTRACT

A tub fixing device is disclosed. The tub fixing device includes a bolt configured to be fastened to a tub, a metal washer configured to have a washer region and a hook region protruded from the washer region, and a spacer configured to be disposed between a cabinet to which the tub is fixed and the washer to limit an open space of the hook region.

13 Claims, 5 Drawing Sheets

300

TUB FIXING DEVICE AND WASHING MACHINE COMPRISING THE SAME

CROSS-REFERENCE TO RELATED APPLICATION

This application is based on and claims priority under 35 U.S.C. § 119 to Korean Patent Application No. 10-2019-0179637, filed on Dec. 31, 2019, in the Korean Intellectual Property Office, the disclosure of which is incorporated by reference herein in its entirety.

BACKGROUND

1. Field

The disclosure relates to a tub fixing device and a washing machine including the same, and more particularly to a tub fixing device for making a user recognize the tub fixing device fastened to a washing machine and inducing the user to detach the tub fixing device, and a washing machine including the same.

2. Description of Related Art

A washing machine is generally an electronic device for removing contaminants attached to laundry by chemical decomposition and mechanical impact. A tub accommodating laundry is simply fixed to the inside the washing machine by a spring and a damper.

When carrying the washing machine, a separate tub fixing device is used in order to prevent the simply fixed tub from flowing. After completing the carrying the washing machine, it is necessary to detach the tub fixing device for normal driving of the tub.

However, there was a problem that the user did not recognize the tub fixing device and used the washing machine while fixing the tub, thereby causing a fault on the washing machine.

SUMMARY

In accordance with an aspect of the disclosure, there is provided a tub fixing device including a bolt configured to be fastened to the tub, a metal washer configured to have a washer region and a hook region protruded from the washer region, and a spacer configured to be disposed between a cabinet to which the tub is fixed and the washer to limit an open space of the hook region.

The hook region has a "U" shape.

One side of the hook region is curved and connected to the washer region.

An inner side of the hook region is deburred.

The open space has an interval of 6 to 10 mm.

A width of the hook region is 12 to 20 mm.

A thickness of the washer is 1 to 3 mm.

The spacer is formed of rubber.

The spacer has a diameter greater than a diameter of the washer region.

The tub fixing device further comprises a second spacer configured to space the tub and the cabinet apart from each other.

In accordance with another aspect of the disclosure, there is provided a washing machine comprising a cabinet configured to form an appearance, a tub configured to be provided to accommodate wash water inside the cabinet, and a tub fixing device configured to fix the tub to the cabinet, in which the tub fixing device comprises a metal washer configured to have a washer region and a hook region protruded from the washer region.

The tub fixing device further comprises a bolt configured to be fastened to the tub, and a spacer configured to be disposed between the cabinet and the washer to limit an open space of the hook region.

The tub comprises a fastening hole, wherein the cabinet has a groove in a region corresponding to the fastening hole, and wherein the bolt penetrates the groove to be inserted to the fastening hole.

The number of the fastening holes, the grooves, and the tub fixing devices is more than one.

The washing machine further comprises a power cord configured to supply power, wherein a region of the power cord is fit to the hook region of the washer.

BRIEF DESCRIPTION OF THE DRAWINGS

The above and other aspects, features, and advantages of certain embodiments of the present disclosure will be more apparent from the following detailed description taken in conjunction with the accompanying drawings, in which.

DETAILED DESCRIPTION

The embodiments described below are exemplified for understanding of the disclosure and it should be understood that the disclosure may be modified and performed variously unlike in the examples described herein. However, in describing the disclosure, a detailed description of the related art or configuration may be omitted when it is determined that the detailed description may unnecessarily obscure a gist of the disclosure. In addition, the accompanying drawings may not be illustrated with actual scales but may be illustrated with enlarged dimensions of some elements, for the understanding of the disclosure.

The terms used in the specification and claims have been selected as general terms as possible in consideration of functions in the embodiments of the disclosure. But, these terms may vary in accordance with the intention of those skilled in the art, the precedent, technical interpretation, the emergence of new technologies and the like. In addition, there are also terms arbitrarily selected by the applicant. Such terms may be interpreted as meanings defined in this specification and may be interpreted based on general content of the specification and common technical knowledge of the technical field, if there are no specific term definitions.

In this disclosure, the terms such as "comprise", "may comprise", "consist of", or "may consist of" are used herein to designate a presence of corresponding features (e.g., constituent elements such as number, function, operation, or part), and not to preclude a presence of additional features.

Further, in the specification, elements necessary for describing each embodiment of the disclosure are described, and accordingly, there is no limitation thereto.

Therefore, some elements may be changed or omitted and other elements may be added.

In addition, the elements may be divided and disposed in different independent devices.

The embodiments of the disclosure will be described in detail with reference to the accompanying drawings and description in the accompanying drawings, but the disclosure is not limited by the embodiments.

An object of the disclosure is to provide a tub fixing device for making a user recognize the tub fixing device fixed to a washing machine and inducing the user to detach the tub fixing device, and a washing machine including the same.

Hereinafter, the disclosure will be described in more detail with reference to the accompanying drawings.

Figure 1:
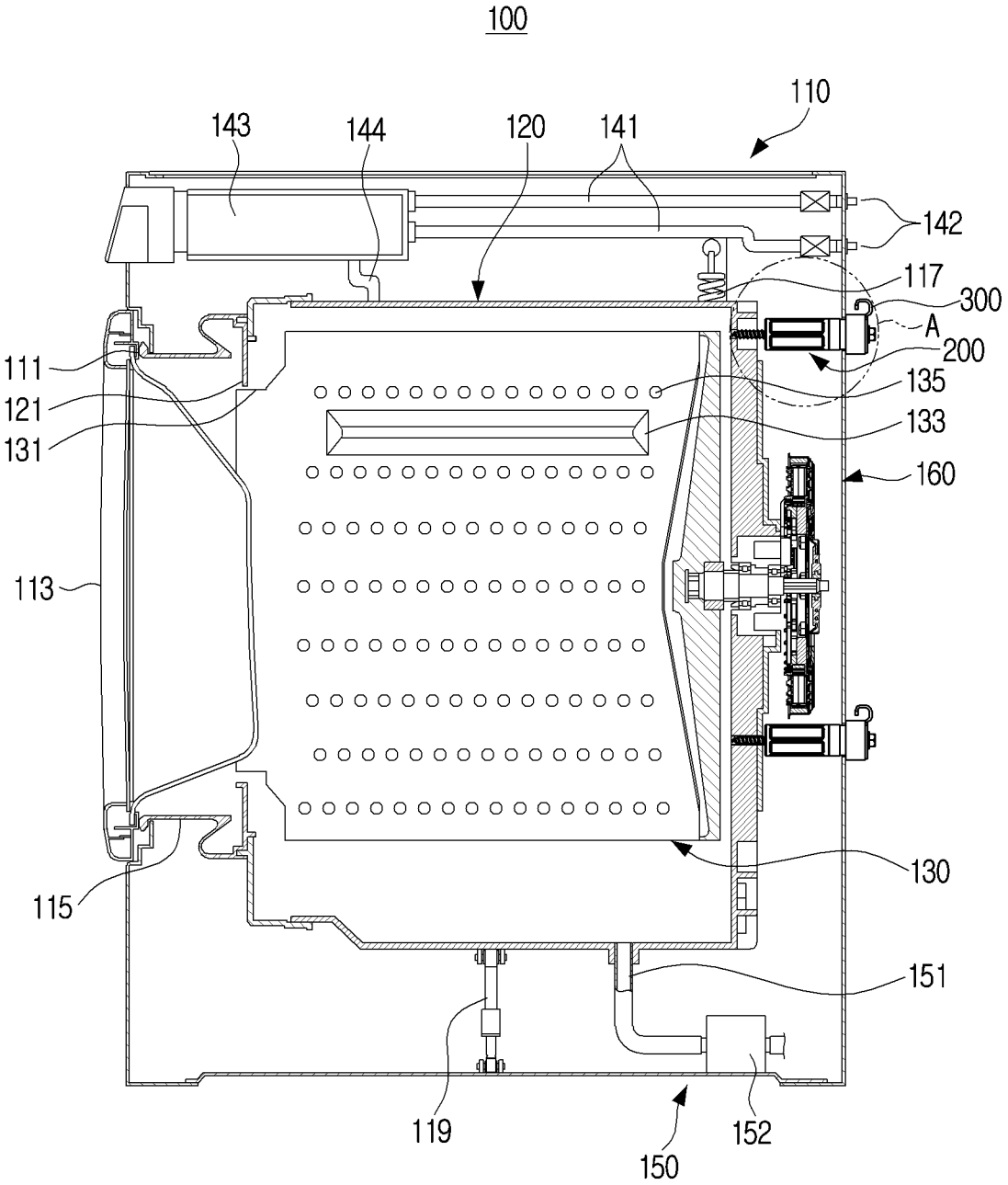
FIG. 1 is a cross-sectional view illustrating a washing machine according to an embodiment.

FIG. 1 is a cross-sectional view illustrating a washing machine 100 according to an embodiment. Referring to FIG. 1, the washing machine 100 may include a cabinet 110, a tub 120, and a motor 160.

The washing machine 100 may remove contaminants attached to laundry by chemical decomposition and mechanical impact. A type of the washing machine 100 may be a drum washing machine for washing laundry using drop of the laundry while rotating a drum, but is not limited thereto.

The cabinet 110 may form appearance of the washing machine 100. The appearance of the washing machine 100 may be formed substantially in a shape of a rectangle by the cabinet 110 but there is no limitation thereto.

The cabinet 110 may be provided with a control panel (not illustrated) including a manipulation panel for receiving operation commands of the washing machine 100 from a user and a display for displaying operation information of the washing machine 100.

An insertion opening 111 is provided on a front surface of the cabinet 110 to load laundry to the drum 130 inside thereof, and openings 121 and 131 corresponding to the insertion opening 111 may be provided on front surfaces of the tub 120 and the drum 130, respectively.

A door 113 for opening and closing the insertion opening 111 may be rotatably installed on the front surface of the cabinet 110.

A diaphragm 115 may be provided between the insertion opening 111 of the cabinet 110 and the opening 121 of the tub 120.

The diaphragm 115 may form a passage for the laundry to pass between the insertion opening 111 of the cabinet 110 and the opening 121 of the tub 120, and reduce vibration transferred to the front surface of the cabinet 110 during the rotation of the drum 130.

In addition, the diaphragm 115 may prevent wash water of the tub 120 from leaking to outside of the cabinet 110.

A spring 117 for supporting the tub 120 at the upper side may be provided between the tub 120 and the cabinet 110. The spring 117 may play a role of alleviating vibration and noise generated due to flowing of the tub 120 by elasticity.

In addition, the tub 120 may be supported by at least one damper 119 in order to alleviate the vibration and impact generated by the flowing of the tub 120. The damper 119 may be installed on a bottom surface of the inside the cabinet 110 to support the tub 120.

In another example, the damper 119 may be installed at upper, right, or left side of the inside the cabinet 110, in addition to the bottom surface, to support the tub 120.

A water supply device for supplying water to the tub 120 may be provided on the upper side of the inside the cabinet 110, and a drainage device 150 for draining wash water used for the washing to outside may be provided on the lower side of the inside the cabinet 110.

The water supply device may include a water supply pipe 141 connected to an external water supply source, a water supply valve 142 disposed in the water supply pipe 141 to open and close the water supply pipe 141, a detergent supply device 143 for mixing a detergent with water transferred via the water supply pipe 141, and a wash water supply pipe 144 connecting the detergent supply device 143 and the tub 120 to guide water and the detergent to the tub 120.

The drainage device 150 may include a drain 151 connected to a lower portion of the tub 120 to guide the wash water used in the tub 120 to be discharged to the outside of the cabinet 110, and a drainage pump 152 provided in the drain 151 to discharge the wash water to the outside via the drainage 151.

The drum 130 may be formed in a hollow cylindrical shape and a plurality of through-holes 135 for wash water to pass may be provided on an outer peripheral surface of the drum 130.

A plurality of lifters 133 for lifting the laundry up may be disposed on an inner peripheral surface of the drum 130 in a circumferential direction at regular interval.

The motor 160 may be a motor for rotating the drum 130 and may be installed on a rear surface of the tub 120. A driving shaft of the motor 160 may be installed on the rear surface of the drum 130 to transfer power of the motor 160 to the drum 130.

When carrying the washing machine 100, the unstable flowing of the tub 120 which is simply fixed by the spring and the damper may occur. Accordingly, the tub fixing device 200 may fix the tub 120 to the rear surface of the cabinet 110 to prevent the flowing of the tub 120.

Specific configuration and function of the tub fixing device 200 will be described below with reference to FIG. 2.

Figure 2:
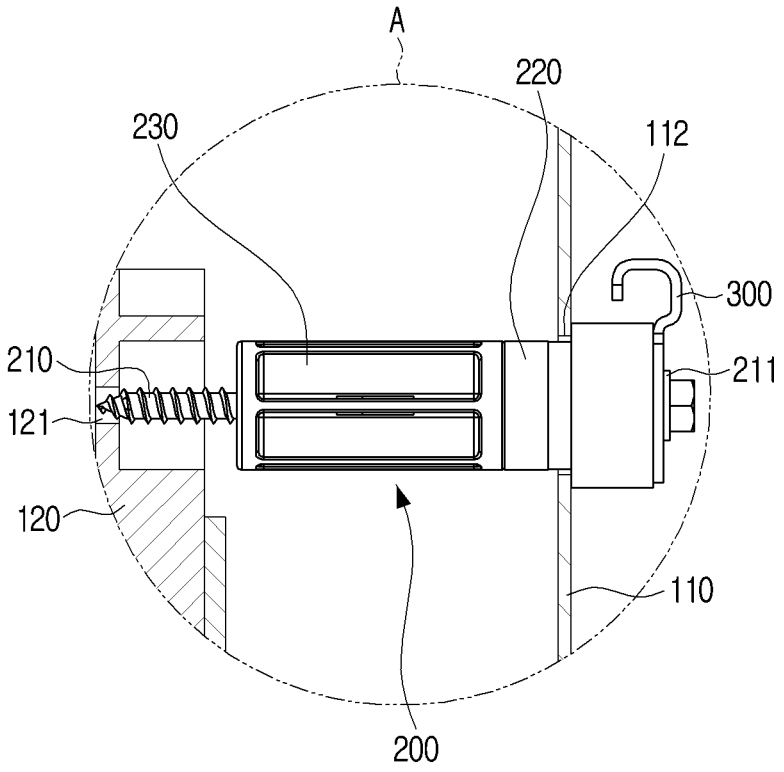
FIG. 2 is an enlarged cross-sectional view of a part A of FIG. 1.

FIG. 2 is a cross-sectional view of an enlarged part A of FIG. 1. Referring to FIG. 2, the tub fixing device 200 may include a bolt 210, a first spacer 220, a second spacer 230, and a washer 300.

The plurality of tub fixing devices 200 according to an embodiment of the disclosure may be formed with fastening holes 121 of the tub 120 and grooves 112 of the cabinet 110. Particularly, the number of each of the tub fixing devices 200, the fastening holes 121, and the grooves 112 may be 3 to 5, but is not limited thereto, and it is enough if it is the number for stably fixing the tub 120 while carrying the washing machine 100.

Hereinafter, for convenience of description, one tub fixing device 200 will be described.

The bolt 210 may be inserted to the fastening hole 121 of the tub 120 to fix the tub 120 to the rear surface of the cabinet 110. Specifically, the bolt 210 may penetrate the groove 112 of the cabinet 110 formed in a region corresponding to the fastening hole 121 to be inserted to the fastening hole 121.

A region of the first spacer 220 may be disposed between the cabinet 110 and the washer 300 to space the cabinet 110 and the washer 300 apart from each other. In addition, the one region of the first spacer 220 may have a larger diameter than that of the groove 112 so that it is not inserted to the groove 112 of the cabinet 110.

The first spacer 220 may be formed of rubber and disposed to come into contact with the inner and outer sides of the rear surface of the cabinet 110. Accordingly, a damage on the cabinet 110 due to the bolt 210 or the washer 300 may be prevented.

The second spacer 230 may space the tub 120 and the cabinet 110 apart from each other. In addition, a through-hole (not illustrated) may be formed therein so that the bolt 210 is able to penetrate.

The washer 300 may be disposed between a head 211 of the bolt 210 and the first spacer 220. The washer 300 may disperse the pressure of the head 211 of the bolt 210 to protect a surface of the first spacer 220. Meanwhile, the washer 300 may include a region having a hook shape and the specific function thereof will be described below.

Figure 3:
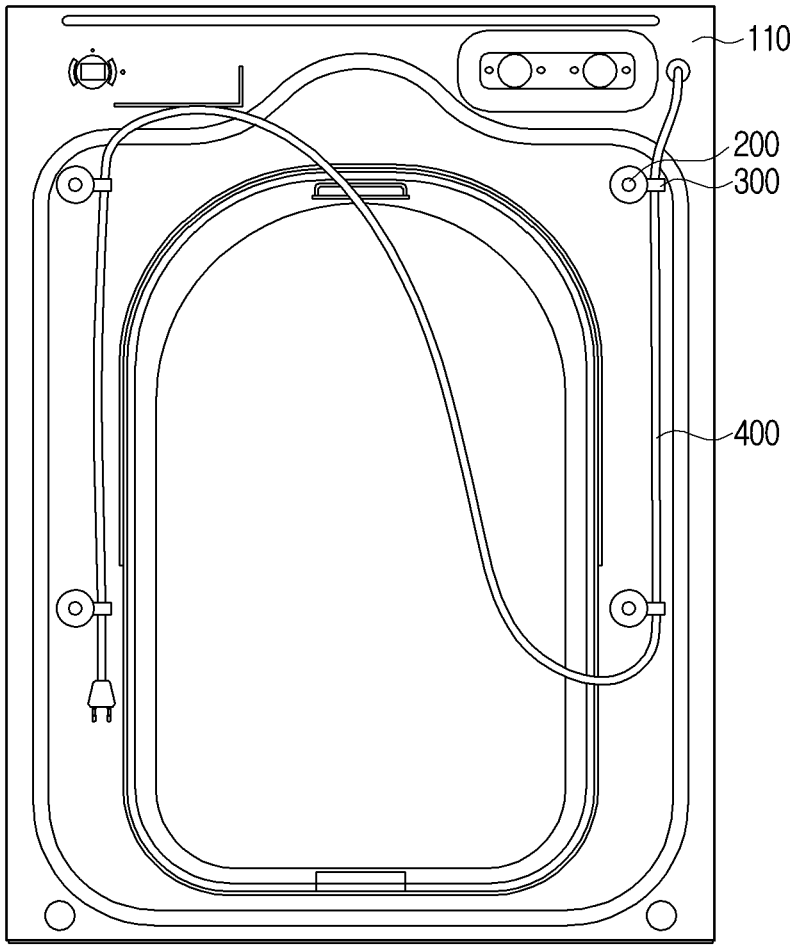
FIG. 3 is a rear view illustrating a rear side of a cabinet according to an embodiment.

FIG. 3 is a rear view illustrating a rear side of a cabinet 110 according to an embodiment. Referring to FIG. 3, one region of a power cord 400 supplying power to the washing machine 100 may be fit to the washer 300.

When installing the washing machine 100, the user has to use the power cord 400 fit to the region of the washer 300 having a hook shape and may recognize and detach the tub fixing device 200 during this process. Accordingly, it is possible to prevent breakdown of the washing machine 100 occurring due to the driving without detaching the tub fixing device 200.

It is illustrated that four tub fixing devices 200 are formed on the rear surface of the cabinet 110, but the number thereof is not limited thereto, and various numbers thereof may be formed according to a size of the washing machine 100 or a length of the power cord 400.

Figure 4:
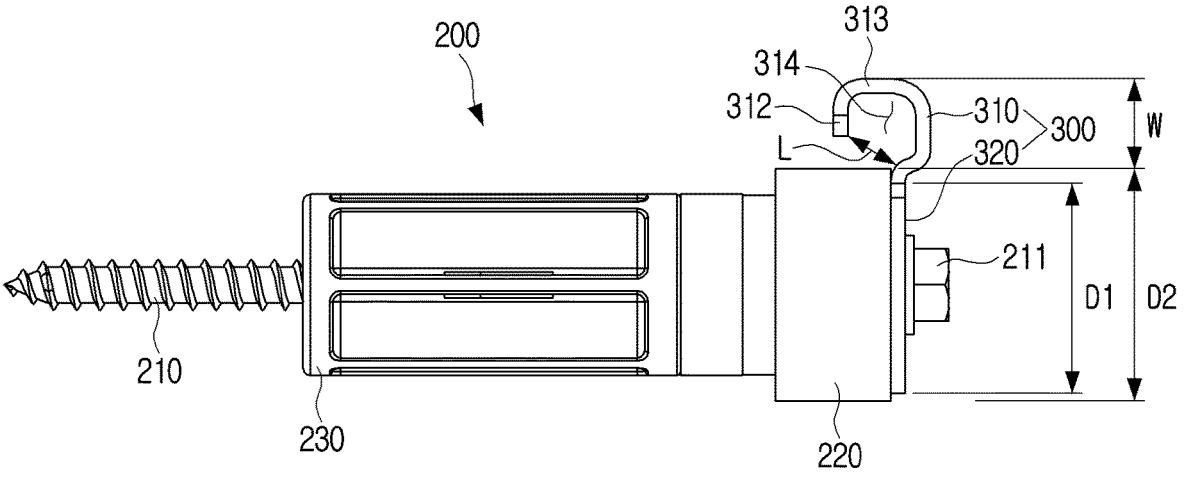
FIG. 4 is a plane view illustrating a tub fixing device according to an embodiment.
Figure 5:
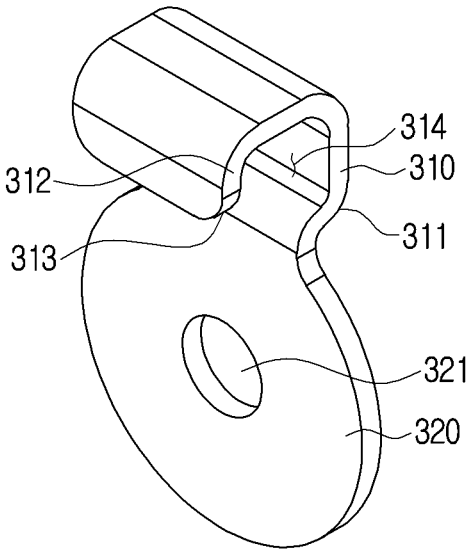
FIG. 5 is a perspective view illustrating a washer of a tub fixing device.

FIG. 4 is a plane view illustrating a tub fixing device 200 according to an embodiment. FIG. 5 is a perspective view illustrating a washer 300 of a tub fixing device 200.

Referring to FIGS. 4 and 5, the tub fixing device 200, particularly the washer 300 according to an embodiment of the disclosure will be described in detail. The same reference numerals may be applied to the same configuration as in the embodiment described above and the description thereof will not be repeated.

Referring to FIGS. 4 and 5, the tub fixing device 200 may include the bolt 210, the first spacer 220, the second spacer 230, and the c 300.

The washer 300 may include a washer region 320 having one surface in contact with the head 211 of the bolt 210 and the other surface in contact with the first spacer 220, and a hook region 310 protruded from the washer region 320 to have a hook shape.

The washer region 320 may have a circular shape and a washer hole 321 penetrating the washer region 320 in a thickness direction may be formed. A diameter of the washer hole 321 may be formed to correspond to a diameter of the bolt 210 and the bolt 210 may penetrate the washer hole 321.

The hook region 310 may have a hook shape so as to cover the power cord 400 of the washing machine 100. Specifically, the hook region 310 may have a "U" shape, and accordingly, one region of the power cord 400 may be stably fixed by the hook region 310.

A width W of the hook region 310 may be 12 to 20 mm, but is not limited thereto, and may be variously formed according to the size of the washing machine 100 or the power cord 400.

One side 311 of the hook region 310 may be curved to be connected to the washer region 320. Specifically, the one side 311 of the hook region 310 may be formed to be curved towards the outside of the rear surface of the cabinet 110. Accordingly, the hook region 310 may be spaced farther from the rear surface of the cabinet 110, thereby minimizing interference of the hook region 310 and the power cord 400 fit to the hook region 310 with respect to the cabinet 110.

The hook region 310 may include two or more curved regions and the other side 312 of the hook region 310 may be formed to be parallel to the cabinet 110. Accordingly, it is possible to prevent damage on the cabinet 110 due to the other side 312 of the hook region 310.

An open space 314 may be formed inside of the hook region 310. The open space 314 may have an interval (L) of 6 to 10 mm, but is not limited thereto and may be formed in various sizes according to the diameter of the power cord 400.

When carrying the washing machine 100, the bolt 210 may penetrate through the washer 300, the first spacer 220, and the second spacer 230 in sequence, while the power cord 400 is fit to the open space 314. Accordingly, the bolt 210 may be inserted to the fastening hole 121 of the tub 120 to fix the tub 120 to the rear surface of the cabinet 110.

Before the tub fixing device 200 is assembled as described above, the power cord 400 may be fit to the open space 314 of the hook region 310. However, after the tub fixing device 200 is assembled, the power cord 400 may not be easily detached since the open space 314 is limited due to the first spacer 220.

A diameter D2 of the first spacer 220 may be formed to be greater than a diameter D1 of the washer region 320. Accordingly, the first spacer 220 may limit the open space 314 of the hook region 310 more effectively.

The first spacer 220 may be formed to have a small size so that it does not come into contact with the other side 312 of the hook region 310. Accordingly, the first spacer 220 and the hook region 310 may be disposed to be adjacent to each other while not interfering each other.

The user may detach the power cord 400 from the hook region 310, only when the tub fixing device 200 is detached from the washing machine 100. Accordingly, the user may necessarily recognize the presence of the tub fixing device 200 fastened to the washing machine 100 and detach this, in order to drive the washing machine 100.

Therefore, it is possible to prevent vibration, noise, and the like generated due to the driving of the washing machine 100 while the tub 120 is fixed.

The washer 300 may be formed of a metal and may be formed of, particularly, pickled-oiled (PO) steel sheets. Since the washer 300 is formed to have a great rigidity, even if the user attempts to detach the power cord 400 with strong power, the power cord 400 may be stably fixed while the washer 300 is not deformed.

An inner side 313 of the hook region 310 in contact with the power cord 400 may be deburred to have a smooth surface. Accordingly, it is possible to prevent damage on the power cord 400 due to a burr of the hook region 310.

While preferred embodiments of the disclosure have been shown and described, the disclosure is not limited to the aforementioned specific embodiments, and it is apparent that various modifications can be made by those having ordinary skill in the technical field to which the disclosure belongs, without departing from the gist of the disclosure as claimed by the appended claims. Also, it is intended that such modifications are not to be interpreted independently from the technical idea or prospect of the disclosure.

What is claimed is:

1. A tub fixing device comprising:

a bolt configured to be fastened to a tub;

a washer that is made of metal, the washer including a washer region formed to extend along a vertical direction of the tub and a hook region formed to include one side to be connected to the washer region and another side formed to protrude from the washer region and be curved to form a space to accommodate a cord;

a first spacer, which is rectangular in shape, configured to have adjacent sides of unequal length and parallel sides that are longer in length that face each other, the first spacer being arrangeable along the vertical direction of the tub and between a cabinet and the washer whereby a diameter of the first spacer along the vertical direction of the tub is greater than a diameter of the washer region along the vertical direction of the tub, and a second spacer configured to be disposed between the tub and the cabinet, the second spacer being perpendicular to the first spacer, wherein the tub is fastened to the cabinet by the bolt which penetrates through the washer, the first spacer, and the second spacer in sequence so that while the tub is fastened by the bolt, the first spacer limits a size of an opening to the space to accommodate the cord that is formed by the hook region, wherein the first spacer is arranged apart from an end of the hook region and limits the opening of the space to accommodate the cord while the diameter of the first spacer along the vertical direction of the tub is such that the first spacer is not in contact with the end of the hook region.

2. The tub fixing device according to claim 1, wherein the hook region has a "U" shape.

3. The tub fixing device according to claim 1, wherein the side of the hook region, which is connected to the washer region is curved.

4. The tub fixing device according to claim 1, wherein an inner side of the hook region is deburred.

5. The tub fixing device according to claim 1, wherein the opening to the space has an interval of 6 to 10 mm.

6. The tub fixing device according to claim 1, wherein a width of the hook region is 12 to 20 mm.

7. The tub fixing device according to claim 1, wherein a thickness of the washer is 1 to 3 mm.

8. The tub fixing device according to claim 1, wherein the first spacer is formed of rubber.

9. The tub fixing device according to claim 1, wherein the second spacer is disposed between the tub and the cabinet to thereby space the tub and the cabinet apart from each other.

10. A washing machine comprising:

a cabinet configured to form an external appearance;

a tub configured to be provided inside the cabinet to accommodate water; and a tub fixing device configured to fix the tub to the cabinet, wherein the tub fixing device comprises:

a washer that is made of metal, the washer including a washer region formed to extend along a vertical direction of the tub and a hook region formed to include one side to be connected to the washer region and another side formed to protrude from the washer region and be curved to form a space to accommodate a cord, a first spacer, which is rectangular in shape, configured to have adjacent sides of unequal length and parallel sides that are longer in length that face each other, the first spacer being arrangeable along the vertical direction of the tub and between the cabinet and the washer whereby a diameter of the first spacer along the vertical direction is greater than a diameter of the washer region along the vertical direction, and a second spacer configured to be disposed between the tub and the cabinet, the second spacer being perpendicular to the first spacer, wherein the tub is configured to be fastened to the cabinet by a bolt penetrating through the washer, the first spacer, and the second spacer in sequence so that while the tub is fastened by the bolt, the first spacer limits a size of an opening to the space to accommodate the cord that is formed by the hook region, wherein the first spacer is arranged apart from an end of the hook region and limits the opening of the space to accommodate the cord while the diameter of the first spacer along the vertical direction of the tub is such that the first spacer is not in contact with the end of the hook region.

11. The washing machine according to claim 10, wherein the tub comprises a fastening hole, wherein the cabinet has a groove in a region corresponding to the fastening hole, and wherein the bolt penetrates the groove to be inserted to the fastening hole.

12. The washing machine according to claim 11, wherein a number of the fastening hole, a number of the groove, and a number of the tub fixing device is more than one.

13. The washing machine according to claim 10, further comprising:

a power cord configured to supply power, wherein a region of the power cord is fitted into the hook region of the washer.

* * * * *